US005809792A

United States Patent [19]

Song

[11] Patent Number: 5,809,792

[45] Date of Patent: Sep. 22, 1998

[54] APPARATUS FOR CONTROLLING REFRIGERATOR EQUIPPED WITH LINEAR COMPRESSOR AND CONTROL METHOD THEREOF

[75] Inventor: Gye-Young Song, Kyungki-Do, Rep. of Korea

[73] Assignee: LG Electronics Inc., Rep. of Korea

[21] Appl. No.: 774,137

[22] Filed: Dec. 26, 1996

[30] Foreign Application Priority Data

Dec. 29, 1995 [KR] Rep. of Korea ..... 67384/1995

[51] Int. Cl.[6] ..... F25B 9/00; F25B 1/00

[52] U.S. Cl. ..... 62/115; 62/6; 62/230; 62/228.5

[58] Field of Search ..... 62/228.5, 231, 62/230, 6, 115

[56] References Cited

U.S. PATENT DOCUMENTS 4,903,502 2/1990 Hanson et al. ..... 62/228.5

5,245,830 9/1993 Aubrun et al. ..... 62/6

5,535,593 7/1996 Wu et al. ..... 62/228.5 X

*Primary Examiner*—William E. Wayner

*Attorney, Agent, or Firm*—Ostrolenk, Faber, Gerb & Soffen, LLP

[57] ABSTRACT

An improved apparatus for controlling a refrigerator equipped with a linear compressor which is capable of achieving an optimum driving efficiency of the system irrespective of an operational condition of a refrigerator by providing the refrigerator with a linear compressor. The apparatus includes an operation ratio computation unit for computing an operation ratio of a compressor, a cooling capacity computation unit for computing a cooling capacity based on a stroke distance of a piston of the compressor, and a controller for maintaining a constant operation ratio by controlling the piston stroke distance in accordance with the operation ratio and the cooling capacity.

10 Claims, 5 Drawing Sheets

APPARATUS FOR CONTROLLING REFRIGERATOR EQUIPPED WITH LINEAR COMPRESSOR AND CONTROL METHOD THEREOF

BACKGROUND OF THE INVENTION

1. Field of the Invention

The present invention relates to an apparatus for controlling a refrigerator equipped with a linear compressor and a control method thereof, and particularly to an improved apparatus for controlling a refrigerator equipped with a linear compressor and a control method thereof which are capable of achieving an optimum driving efficiency of the system irrespective of the operational conditions of the refrigerator by controlling the operation ratio of the linear compressor and the stroke distance of the piston.

2. Description of the Conventional Art

FIG. 1 is a schematic diagram illustrating the construction of a conventional refrigerator.

As shown therein, the conventional refrigerator includes a compressor 11 for compressing a refrigerant gas to high temperature and pressure, a condenser 12 for condensing the high pressure refrigerant gas compressed by the compressor 11 to a liquid state refrigerant, a capillary tube 13 for changing the refrigerant condensed by the condenser 12 to a low temperature liquid state refrigerant, an evaporator 14 for evaporating the low temperature liquid state refrigerant introduced thereinto through the capillary tube 13, and a temperature controller 17 disposed within a freezing compartment 15 for controlling the electric power to the compressor 11 and the fan motor 16 when a switch is turned on/off in accordance with the temperature in the freezing compartment 15.

In the drawings, reference numeral 18 denotes a refrigeration compartment, 19 denotes a refrigerator body, 20 denotes an insulation wall, and 21 denotes a suction tube.

FIG. 2 is a diagram illustrating the relationship between a compressor, a fan motor, and a temperature controller of FIG. 1, and FIG. 3 is a cross-sectional view illustrating the construction of a conventional linear compressor.

In the drawings, reference numeral 31 denotes a piston spring, 32 denotes an outer lamination plate, 33 denotes a motor coil, 34 denotes a permanent magnet, 35 denotes an inner lamination plate, 36 denotes a cylinder, 37 denotes a piston, 38 denotes a discharge valve, and 39 denotes a suction valve.

The operation of the conventional refrigerator will now be explained with reference to the accompanying drawings.

As shown in FIGS. 1 and 2, the temperature controller 17 disposed within the freezing compartment 15 turns on the switch when the temperature in the freezing compartment 15 exceeds a predetermined set temperature, for thus supplying electric power to the compressor 11 and the fan motor 16.

Here, the compressor compresses the refrigerant gas to high temperature and pressure and transfers the gas to the condenser 12. The thusly compressed refrigerant gas is heat-exchanged with air surrounding the condenser and then is introduced into the capillary tube 13.

Thereafter, the refrigerant gas introduced into the capillary tube 13 is converted into a low temperature liquid refrigerant, and the pressure thereof is lowered. The thusly pressure-lowered refrigerant is transferred to the evaporator 14. The evaporator 14 evaporates the low temperature liquid state refrigerant, for thus cooling the air in the freezing compartment 15, and the refrigerant gas evaporated is introduced into the compressor as a new refrigerant gas.

When the air in the freezing compartment 15 has been substantially cooled, and the temperature of the freezing compartment 15 reaches below a previously set temperature, the switch of the temperature controller 17 is turned off, and the compressor 11 and the fan motor 16 are stopped, for thus finishing the cooling operation.

The conventional refrigerator is directed basically to repeating the above-described processes, for thus cooling the air in the freezing compartment of the refrigerator.

Generally, in the conventional refrigerator, when the surrounding, i.e. ambient temperature around the refrigerator is 30° C., and there are no foods in the refrigerator, the compressor 11 is operated for about 20 minutes, and then is stopped for about 25 minutes. The above-described operation is repeatedly performed cycled, for thus maintaining the temperature of the freezing compartment at about −18° C.

The time ratio at which the compressor 11 is operated is called the operation ratio of the compressor. The operation ratio of the compressor can be expressed as follows.

The operation ratio=(operation duration time/(operation duration time+stop duration time))×100 - - - (1)

=(20/(20+25))×100=44.4%

In the conventional refrigerator, since the heat energy externally transferred into the refrigerator through the insulation wall 20 and the amount of the heat exchange by the condenser are varied in accordance with the variation of the surrounding temperature, the efficiency of the refrigerator is not constant.

Namely, when the heat energy transfer amount "Q" through the insulation wall 20 is $Q_F+Q_R=h_FA_F\Delta T_F+h_RA_R\Delta T_R$, on the assumption that the value h is constant based on a condition "$h_RA_R=2h_FA_F$", the following expression can be obtained.

The amount of heat transfer $Q=h_FA_F(\Delta T_F+2\Delta T_R)$ - - - (2)

where $Q_F$ denotes the amount of a heat transfer into the freezing compartment through the insulation wall, and $Q_R$ denotes the amount of the heat transfer into the refrigerating compartment through an insulation wall of the refrigerating compartment, h denotes a heat transfer coefficient, A denotes a heat transfer area, ΔT denotes a temperature difference, $_F$ denotes the freezing compartment, and $_R$ denotes the refrigerating compartment.

When the temperature of the refrigerating compartment 18 is maintained at 3° C., the temperature of the freezing compartment 15 is maintained at −18° C., and the surrounding temperature is changed from 15° C. to 30° C., the amount "Q" of the heat transfer is "$[h_FA_F(15-(-18)+2(15-3)]=57h_FA_F$" when the surrounding temperature is 15° C., and the amount "Q" of the heat transfer is $102h_FA_F$ when the surrounding temperature is 30° C.

Therefore, the amount of the heat transfer is increased by 1.8 times when the surrounding temperature is 30° C. as compared to when the surrounding temperature is 15° C.

In addition, if expressing the amount of the heat exchange of the condenser in the same manner, it is known that the amount of the heat exchange is varied based on the variation of $\Delta T_c$ when the surrounding temperature is varied under the condition "$Q=h_cA_c\Delta T_c$".

Therefore, in order to effectively operate the refrigerator, the cooling capacity of the compressor must be varied in accordance with the surrounding environments of the refrigerator and a food storage state.

However, since the conventional refrigerator uses a reciprocating type compressor, the cooling capacity of the compressor is disadvantageously constant because the RPM of the motor and the operation distance of a piston are constant, so that the efficiency of the refrigerator is low.

SUMMARY OF THE INVENTION

Accordingly, it is an object of the present invention to provide an apparatus for controlling a refrigerator equipped with a linear compressor and a control method thereof which overcomes the aforementioned problems encountered in the conventional art.

It is another object of the present invention to provide an improved apparatus for controlling a refrigerator equipped with a linear compressor which is capable of achieving an optimum driving efficiency of the system by changing a freezing capacity of the compressor in accordance with an operational condition of the refrigerator by providing a linear compressor which is capable of controlling a freezing capacity of the compressor by varying the current applied to a motor coil of the compressor.

To achieve the above objects, there is provided an apparatus for controlling a refrigerator equipped with a linear compressor which includes an operation ratio of a compressor, a cooling capacity computation unit for computing a cooling capacity based on a stroke distance of a piston of the compressor, and a controller for maintaining a constant operation ratio by controlling the piston stroke distance in accordance with the operation ratio and the cooling capacity.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
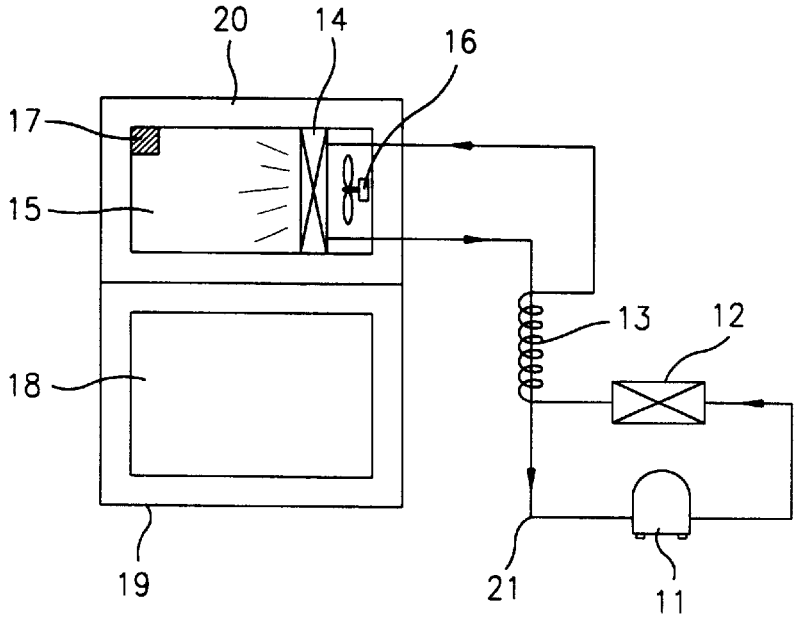
FIG. 1 CONVENTIONAL ART
FIG. 1 is a schematic diagram illustrating the construction of a conventional refrigerator.
Figure 2:
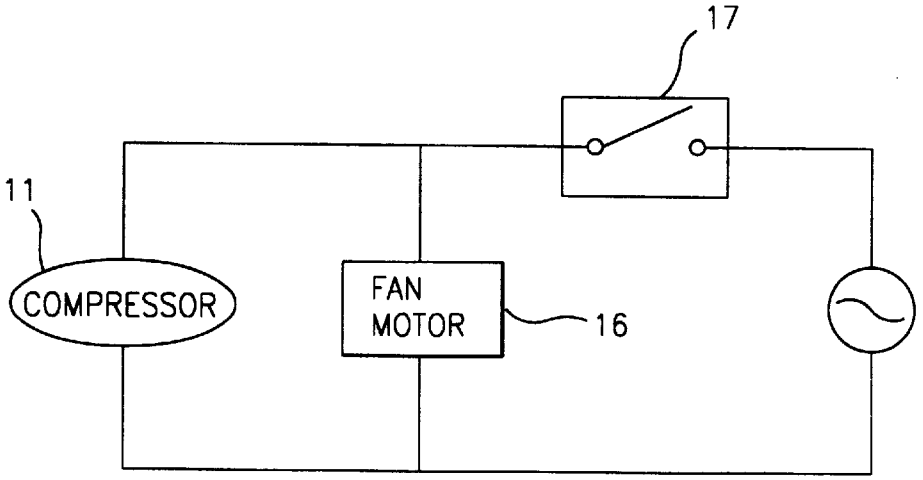
FIG. 2 CONVENTIONAL ART
FIG. 2 is a diagram illustrating the relationship between a compressor, a fan motor, and a temperature controller of FIG. 1.
Figure 3:
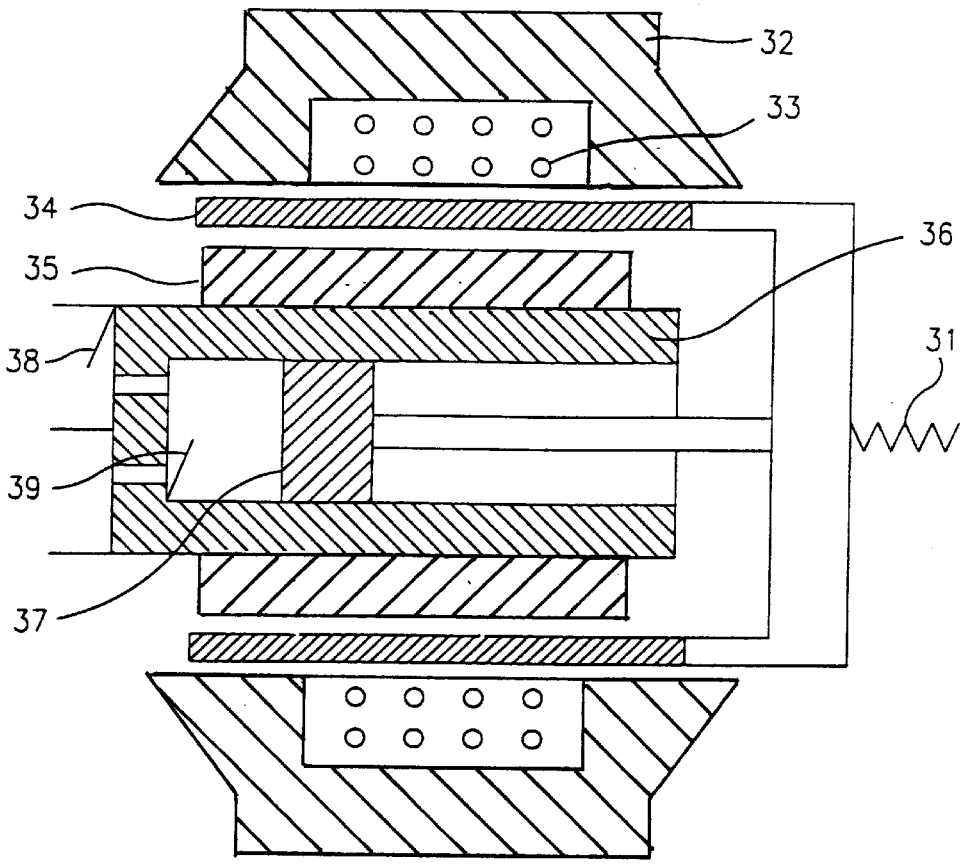
FIG. 3 CONVENTIONAL ART
FIG. 3 is a cross-sectional view illustrating the construction of a conventional linear compressor.

FIG. 3 is a cross-sectional view illustrating the construction of a conventional linear compressor.

As shown therein, since the stroke of a piston 37 can be controlled by varying the voltage or the amount of the current applied to a motor coil 33 of the compressor, the stroke distance of the piston 37 is measured during an operation of the refrigerator by providing a piston position sensor in the compressor, which is capable of measuring the time-based position variation of the piston, for thus computing the operation ratio by detecting the amount of current of the compressor, whereby it is possible to predict the conditions under which the refrigerator is operated based on the operation ratio.

Figure 4:
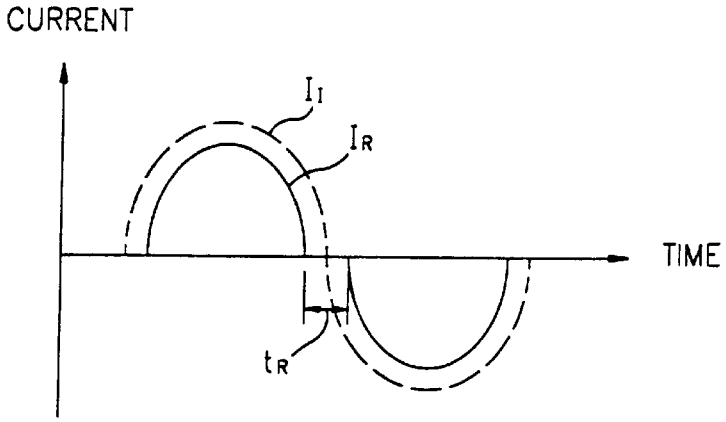
FIG. 4 is a graph illustrating a current waveform during a phase control by using a triac of an apparatus for controlling of a refrigerator equipped with a linear compressor according to the present invention.

The control apparatus for a refrigerator equipped with a linear compressor is basically directed to computing the cooling capacity of the refrigerator based on the stroke distance of the piston 37 in order for the operation ratio to be 30%–50% in accordance a the result of the computation, so that an optimum cooling efficiency of the refrigerator can by obtained at the operation ratio. As shown in FIG. 4, the amount of current of the compressor can be controlled by controlling the phase, for example, by terminating the current supply for a predetermined time $T_R$ by using the triac. Namely, the freezing capacity of the compressor is controlled by varying the stroke distance of the piston of the compressor by controlling the voltage or current.

Figure 5:
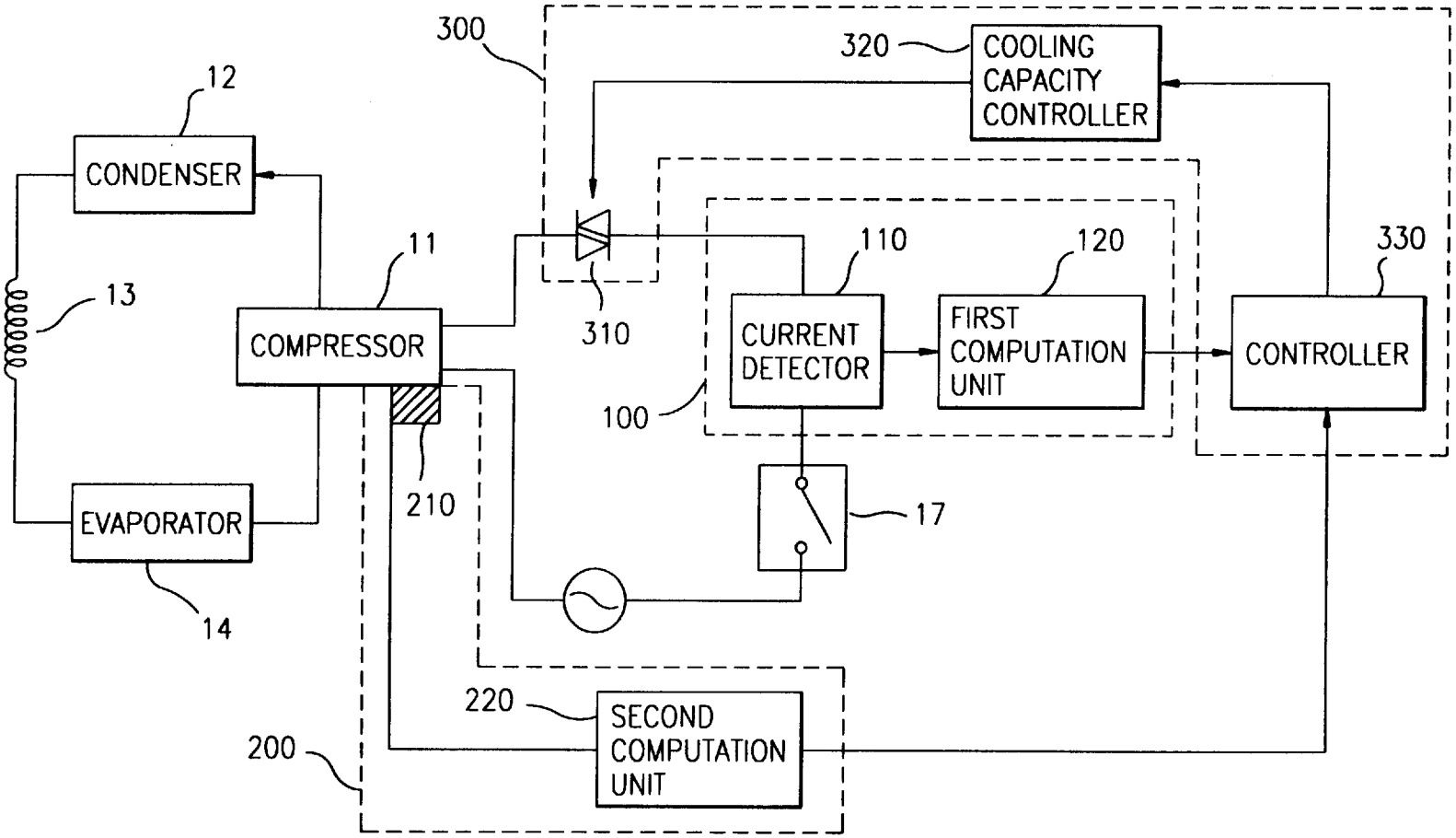
FIG. 5 is a block diagram illustrating an apparatus for controlling a refrigerator equipped with a linear compressor according to a first embodiment of the present invention.

FIG. 5 is a block diagram illustrating an apparatus for controlling a refrigerator equipped with a linear compressor according to a first embodiment of the present invention.

As shown therein, the control apparatus for a refrigerator equipped with a linear compressor according to the present invention includes a current detector 110 for detecting a current being applied to a compressor 11, an operation ratio computation unit 100 having a first computation unit 120 for computing an operation ratio based on the current detection time and the current non-detected time in accordance with a detection result of the current detector 110, a position sensor 210 disposed in the compressor 11 for detecting the position of the piston, a cooling capacity computation unit 200 having a second computation unit 220 for predicting the cooling capacity by computing the stroke distance from the position of the piston detected, for thus computing the cooling capacity of the compressor 11, a triac 310 for phase-controlling a current waveform inputted to the compressor 11, and a control unit 300 provided with a driving controller 320 for driving the triac 310 in accordance with an operational ratio and freezing capacity of the compressor and a controller 330 for controlling the input voltage of the compressor by controlling the driving controller 320, so that the input voltage of the compressor is controlled in accordance with the freezing capacity and the stroke distance of the piston of the compressor is controlled, thus maintaining a proper operational ratio.

The operation of the apparatus for controlling a refrigerator equipped with a linear compressor according to a first embodiment of the present invention will now be explained with reference to the accompanying drawings. When the amount of the heat transfer into the refrigerating compartment 18 and the refrigerating compartment 15 is decreased, since the amount of the transferred heat is smaller than the freezing capacity which is obtained for a short time by the compressor 11, the operation of the refrigerator is stopped after the compressor 11 is turned on. Namely, the On time of the compressor is decreased, and the compressor 11 stops after a predetermined time. Therefore, since the freezing cycle composed of the compressor 11, the condenser 12, the capillary tube 13, and the evaporator 14 are unstably stopped, the operation time of the compressor 11 is decreased, and then the operation ratio of the refrigerator is decreased. At this time, the driving controller 320 which is controlled by the controller 330 controls the phase of the current inputted into the compressor 11 through the triac 310, decreases the input power voltage of the compressor 11 and the piston stroke distance (the increase of $T_R$), and decreases the freezing capacity of the compressor 11.

Therefore, the instant cooling capacity of the compressor 11 is decreased, and the operation ratio of the refrigerator is maintained not to be decreased below 30%.

In addition, when the surrounding temperature of the refrigerator is high, the amount of the heat transfer of the refrigerator is increased, and the cooling capacity of the compressor 11 is constant, the operation ratio of the refrigerator is increased and exceeds 50%.

Here, the controller 300 increases the piston stroke distance of the compressor 11 (the decrease of $T_R$), so that the freezing capacity of the compressor 11 is increased, and the operation ratio of the refrigerator does not exceed 50%.

Continuously, the second computation unit 220 of the cooling capacity computation unit 200 transmits the cooling capacity predicted by using the piston stroke distance measured by the piston position sensor 210 to the controller 330 of the controller unit 300, and the first computation unit 120 of the operation ratio computation unit 100 computes the operation ratio based on a result detected by the current detector 110 and transmits the ratio to the controller 330, and the controller of the controller unit 300 controls the triac 310 and the driving controller 320 based on the cooling capacity and the operation ratio.

Therefore, the above-described processes are repeatedly performed, for thus obtaining an optimum cooling efficiency of the refrigerator.

Figure 6:
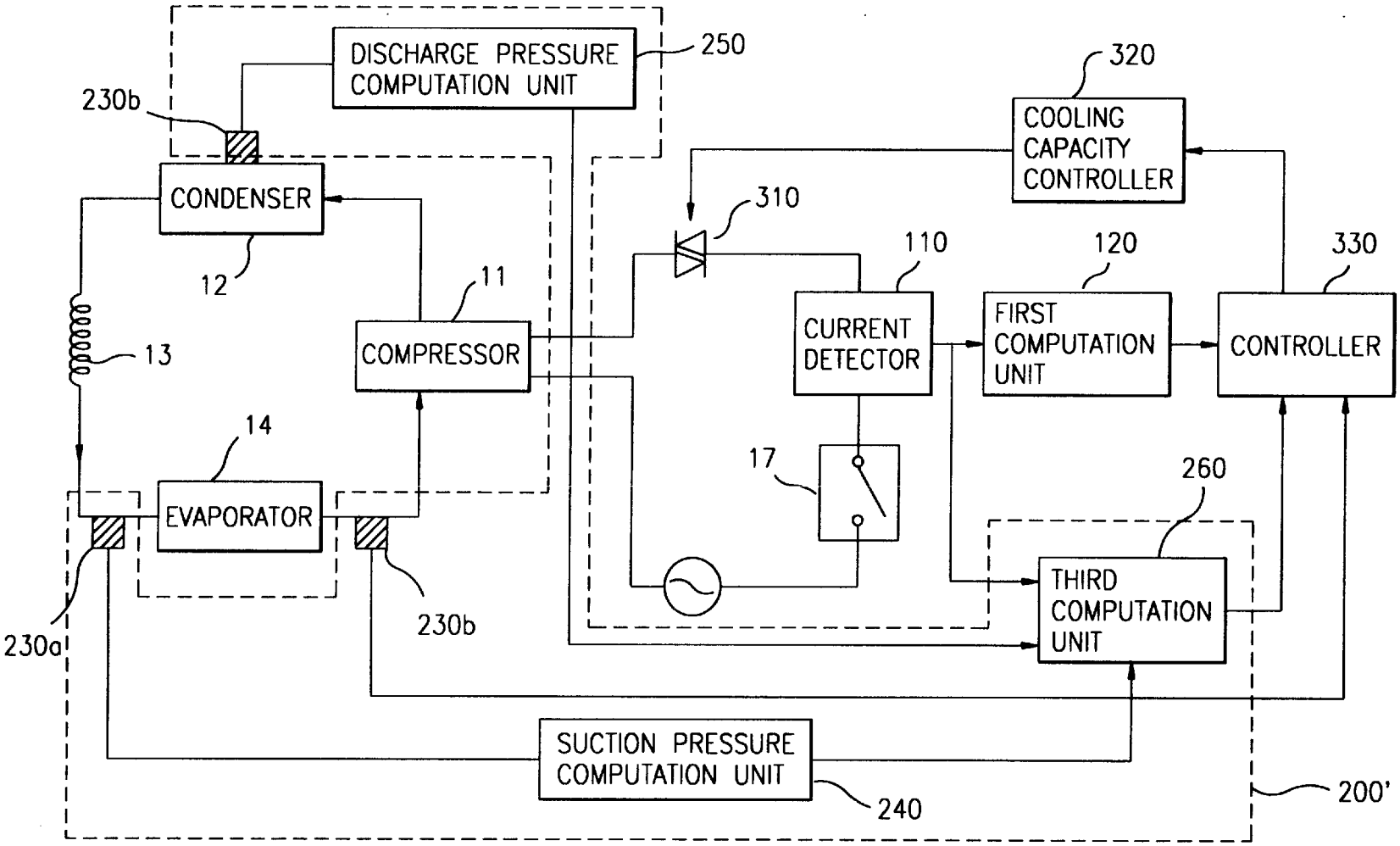
FIG. 6 is a block diagram illustrating an apparatus for controlling a refrigerator equipped with a linear compressor according to a second embodiment of the present invention.

FIG. 6 is a block diagram illustrating an apparatus for controlling a refrigerator equipped with a linear compressor according to a second embodiment of the present invention.

As shown therein, if it is impossible to attach the piston position sensor to a portion of the compressor 11, the second embodiment of the present invention is implemented by changing elements of the cooling capacity computation unit 200.

Namely, a cooling capacity computation unit 200' includes a suction pressure computation unit 240 for computing the suction pressure of the compressor 11 based on the temperature detected by a first temperature sensor 230*a* disposed at an entrance of the evaporator 14, a discharge pressure computation unit 250 for computing a compressor discharge pressure based on the temperature detected by a second temperature sensor 230*b* disposed in the center portion of the condenser 12, a third computation unit 260 for predicting the cooling capacity of the compressor 11 by computing the piston stroke distance based on the suction pressure, the discharge pressure, and the amount of current measured by the current detector 110, and a third temperature sensor 230*c* disposed at an outlet of the evaporator for transferring the temperature detected to the controller 330 of the controller unit 300.

Here, a pressure sensor may be preferably used instead of the temperature sensors 230*a* and 230*b* for measuring the suction pressure and discharge pressure of the compressor 11.

The operation of the second embodiment of the present invention may be identical with the first embodiment of the present invention. The third temperature sensor 230*c* transfers the temperature detected at the outlet of the evaporator to the controller 330, and the controller 330 controls the cooling capacity of the compressor 11 in order for the temperature difference between the entrance portion and the outlet portion of the evaporator 14 not to occur, so that the operation ratio of the refrigerator can be 30%~50%. Namely, when the cycle operation of the refrigerator is performed, the controller 330 measures the temperatures of the refrigerant at the entrance and the outlet of the evaporator 14. If the temperature at the entrance of the evaporator 14 is lower than that at the outlet of the same by more than 1° C., and the operation ratio exceeds 50% the input voltage of the compressor is increased. And if the temperature difference between the entrance and outlet of the evaporator is below 1° C., and the operational ratio is below 30%, the voltage inputted into the compressor is decreased.

Figure 7:
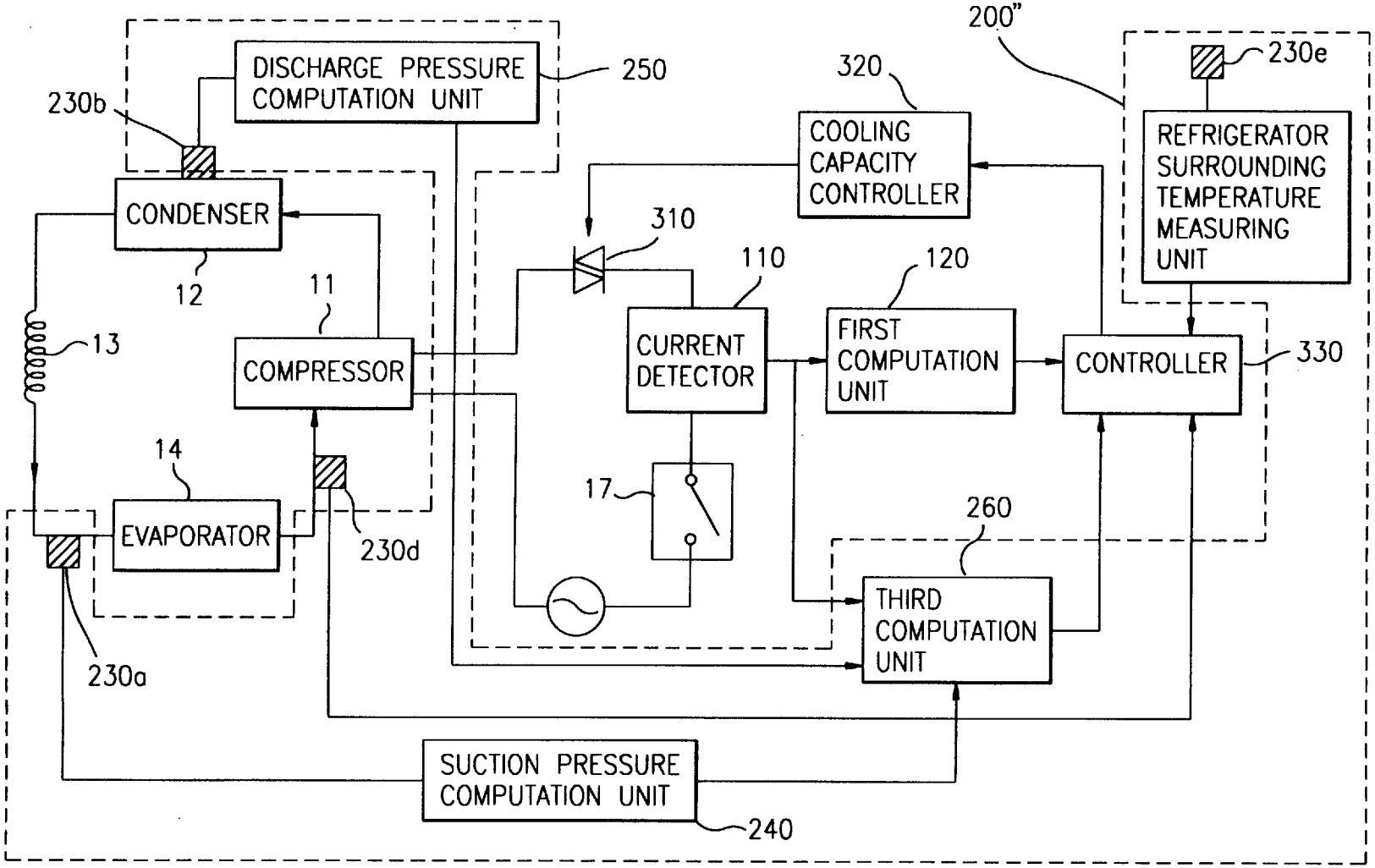
FIG. 7 is a block diagram illustrating an apparatus for controlling a refrigerator equipped with a linear compressor according to a third embodiment of the present invention.

In a third embodiment of the present invention, the cooling capacity computation unit 200", as shown in FIG. 7, includes a first temperature sensor 230*d* attached to a portion of a suction tube 21 away from the compressor 11 by 10 cm~15 cm for measuring the temperature of the suction tube, and a second temperature sensor 230*e* attached to a casing of the refrigerator for measuring the surrounding temperature of the refrigerator and for transferring to the controller 330 of the controller unit 300.

The controller 330 varies the piston stroke distance of the compressor 11, for thus controlling the cooling capacity of the compressor 11, so that the temperature of the suction tube and the surrounding temperature of the refrigerator become identical.

As described above, the apparatus for controlling a refrigerator equipped with a linear compressor according to the present invention is directed to accurately checking the operation state of the refrigerator by providing the temperature sensor, the pressure sensor, the current detector, and the piston position sensor. In addition, it is possible to maintain an optimum operation state of the refrigerator by using the linear compressor by which it is possible to accurately control the cooling capacity of the compressor. Namely, if the temperature of the suction tube is lower than the surrounding temperature of the refrigerator by more than 3° C., and the operational ratio is below 30%, the voltage inputted into the compressor 11 is decreased, and if the temperature difference between the suction tube and the surrounding temperature is within 2° C., and the operational ratio is above 50%, the voltage inputted into the compressor 11 is increased.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An apparatus for controlling a refrigerator equipped with a linear compressor, of said refrigerator comprising:

an operation ratio computation unit for computing an operation ratio of a compressor;

a cooling capacity computation unit for computing a cooling capacity based on a stroke distance of a piston of the compressor; and a controller for maintaining a constant operation ratio by controlling the piston stroke distance in accordance with the operation ratio and the cooling capacity.

2. The apparatus of claim 1, wherein said operation ratio computation unit includes:

a current detector for detecting a current applied to the compressor; and a first computation unit for computing the operation ratio by using a current detection time and a current non-detected time in accordance with a detection result of the current detector.

3. The apparatus of claim 1, wherein said cooling capacity computation unit includes:

a position sensor disposed in the compressor for detecting the position of the piston; and a second computation unit for predicting the cooling capacity by computing the stroke distance from the position of the piston detected.

4. The apparatus of claim 1, wherein said controller includes:

a triac connected to the compressor for phase-controlling a current waveform inputted to the compressor;

a driving controller for driving the triac; and a sub-controller for controlling the driving controller in accordance with the operational ratio and freezing capacity inputted from the operational ratio computation unit and freezing capacity computation unit.

5. The apparatus of claim 1, wherein said cooling capacity computation unit includes:

a first temperature sensor disposed at an entrance of an evaporator of said refrigerator;

a suction pressure computation unit for computing a suction pressure of the compressor by using the temperature detected by the first temperature sensor;

a second temperature sensor disposed in a center portion of a condenser of said refrigerator;

a discharge pressure computation unit for computing a discharge pressure of the compressor by using the temperature detected by the second temperature sensor;

a third computation unit for predicting the cooling capacity by computing the piston stroke distance based on the suction pressure, discharge pressure and current level of the compressor; and a third temperature sensor disposed in an outlet portion of the evaporator for transmitting the temperature detected at the outlet portion of the evaporator to the controller.

6. The apparatus of claim 1, wherein said cooling capacity computation unit includes:

a first temperature sensor disposed at an entrance of a evaporator of said refrigerator;

a suction pressure computation unit for computing a suction pressure of the compressor by using the temperature detected by the first temperature sensor;

a second temperature sensor disposed in a center portion of a condenser of said refrigerator;

a discharge pressure computation unit for computing a discharge pressure of the compressor by using the temperature detected by the second temperature sensor;

a third computation unit for predicting the cooling capacity by computing the piston stroke distance based on the suction pressure, discharge pressure, and current amount of the compressor; and a temperature sensor disposed in a suction tube of the compressor and a casing of the refrigerator for measuring the temperature of the suction tube and the surrounding temperature of the refrigerator.

7. The apparatus of claim 1, wherein said cooling capacity computation unit includes:

a first pressure sensor disposed in the entrance portion of the evaporator and a second pressure sensor disposed at the center portion of the condenser, respectively;

a suction pressure computation unit for computing a suction pressure of the compressor by using the pressure detected by the first pressure sensor;

a discharge pressure computation unit for computing a discharge pressure of the compressor by using the pressure detected by the second pressure sensor;

a third computation unit for predicting the cooling capacity by computing a piston stroke distance based on the suction pressure, discharge pressure and current of the compressor; and a temperature sensor disposed in an outlet portion of the evaporator for transmitting the temperature detected at the outlet portion of the evaporator to the controller.

8. A method for controlling a refrigerator equipped with a linear compressor, the method comprising:

computing an operation ratio of a compressor of said refrigerator;

computing a cooling capacity based on a stroke distance of the piston of the compressor; and maintaining a constant operation ratio by controlling the piston stroke distance in accordance with the operation ratio and the cooling capacity.

9. The method of claim 8, in which the step of computing an operation ratio includes the further steps of:

detecting a current applied to the compressor; and computing the operation ratio by using a current detection time and a current non-detected time in accordance with a detection result obtained during the step of detecting a current applied to the compressor.

10. The method of claim 8, in which the step of computing the cooling capacity includes:

detecting the position of the piston; and predicting the cooling capacity by computing the stroke distance from the detection of the position of the piston.

* * * * *